US010394156B2

(12) United States Patent
Ozeki

(10) Patent No.: US 10,394,156 B2
(45) Date of Patent: Aug. 27, 2019

(54) IMAGE FORMATION APPARATUS CONTROLLING CHARGING VOLTAGE AND DEVELOPMENT VOLTAGE

(71) Applicant: Oki Data Corporation, Tokyo (JP)

(72) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/033,269

(22) Filed: Jul. 12, 2018

(65) Prior Publication Data

US 2019/0018338 A1 Jan. 17, 2019

(30) Foreign Application Priority Data

Jul. 14, 2017 (JP) ..... 2017-138131

(51) Int. Cl.
*G03G 15/02* (2006.01)
*G03G 15/06* (2006.01)
*G03G 15/00* (2006.01)

(52) U.S. Cl.
CPC ..... *G03G 15/0266* (2013.01); *G03G 15/065* (2013.01); *G03G 15/5008* (2013.01)

(58) Field of Classification Search
CPC .. G03G 15/0266; G03G 15/065; G03G 15/50; G03G 15/5004; G03G 15/5008
See application file for complete search history.

(56) References Cited

U.S. PATENT DOCUMENTS

2004/0005160 A1* 1/2004 Kawamura ..... G03G 15/065 399/55
2004/0042813 A1* 3/2004 Takai ..... G03G 15/5004 399/88
2009/0136252 A1* 5/2009 Hashimoto ..... G03G 15/5004 399/82
2010/0135685 A1* 6/2010 Chang ..... G03G 15/065 399/55
2015/0098717 A1* 4/2015 Park ..... G03G 15/065 399/46
2015/0362885 A1* 12/2015 Iwayama ..... G03G 15/0266 399/53
2016/0223936 A1* 8/2016 Funatsu ..... G03G 15/065
2017/0031315 A1* 2/2017 Suzuki ..... G03G 15/50
2018/0149993 A1* 5/2018 Tetsuno ..... G03G 15/0266

FOREIGN PATENT DOCUMENTS

JP 2015-219367 A 12/2015

* cited by examiner

*Primary Examiner* — Sophia S Chen
(74) *Attorney, Agent, or Firm* — Metrolex IP Law Group, PLLC

(57) ABSTRACT

An image formation apparatus according to an embodiment includes: an image carrier; a charging member facing the image carrier; a developer carrier facing the image carrier; and a controller that controls a rotating operation of the image carrier, application of a charge voltage to the charging member, and application of a development voltage to the developer carrier. In a first period, the controller sets an absolute value of a voltage difference between a DC component of the charge voltage and a DC component of the development voltage to a first value to develop a latent image on the image carrier. In a second period after the first period, the controller sets the absolute value of the voltage difference to a second value smaller than the first value.

11 Claims, 7 Drawing Sheets

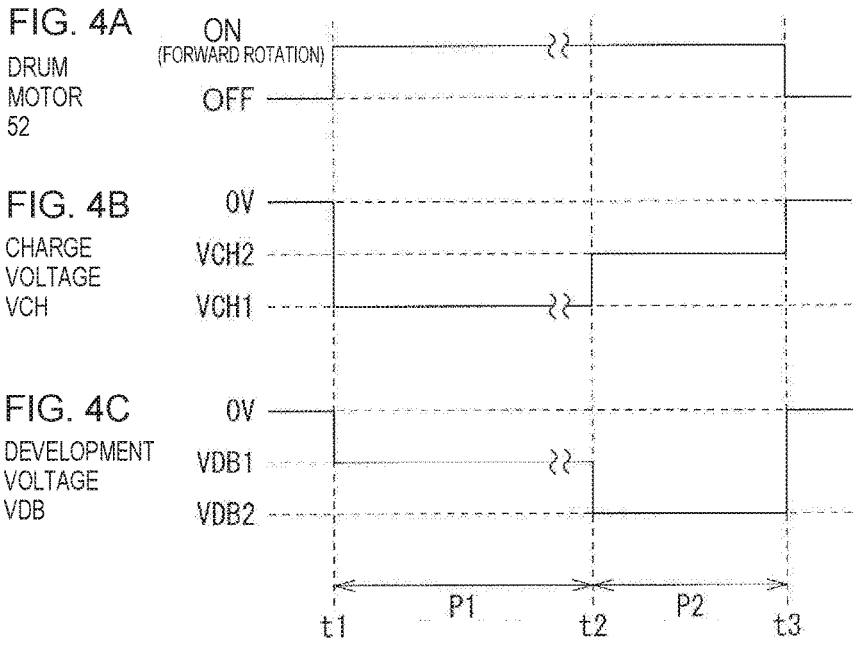
FIG. 5
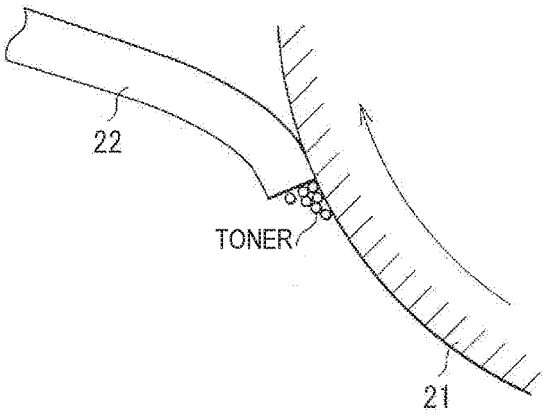

| | IMAGE FORMING PERIOD P1 | PERIOD P2 |
|---|---|---|
| CHARGE VOLTAGE VCH | -1000V | -850V |
| DEVELOPMENT VOLTAGE VDB | -150V | -200V |
| VOLTAGE DIFFERENCE ΔV | -850V | -650V |

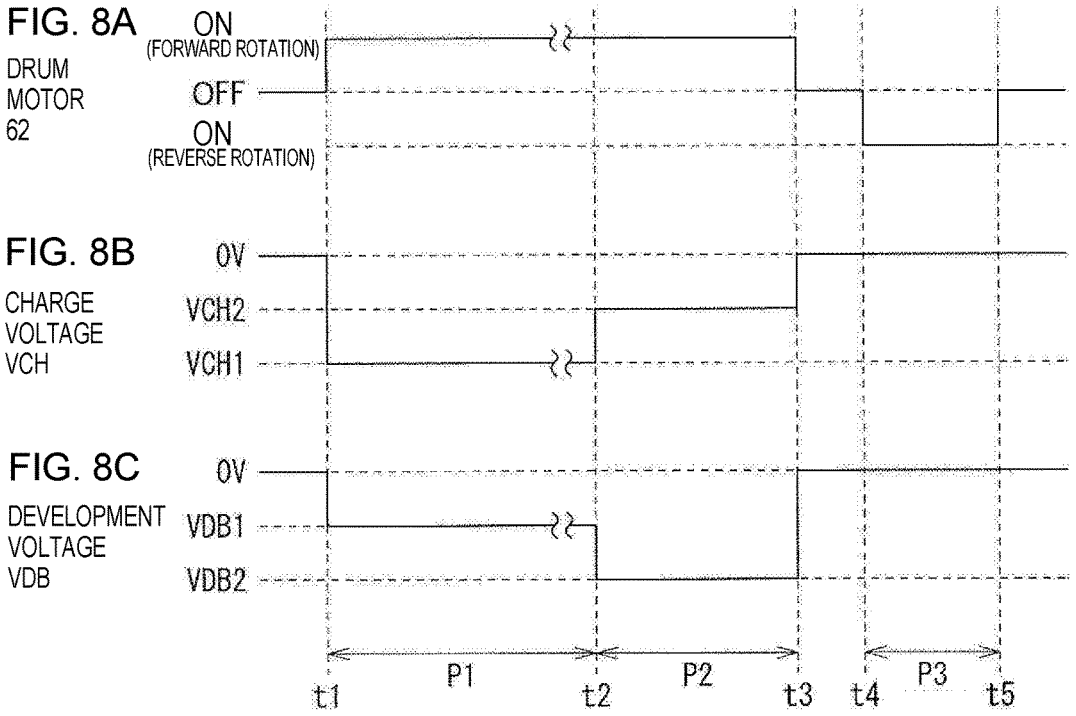
FIG. 8A
DRUM MOTOR 62
ON (FORWARD ROTATION)
OFF
ON (REVERSE ROTATION)
FIG. 8B
CHARGE VOLTAGE VCH
0V
VCH2
VCH1
FIG. 8C
DEVELOPMENT VOLTAGE VDB
0V
VDB1
VDB2
P1
P2
P3
t1
t2
t3
t4
t5
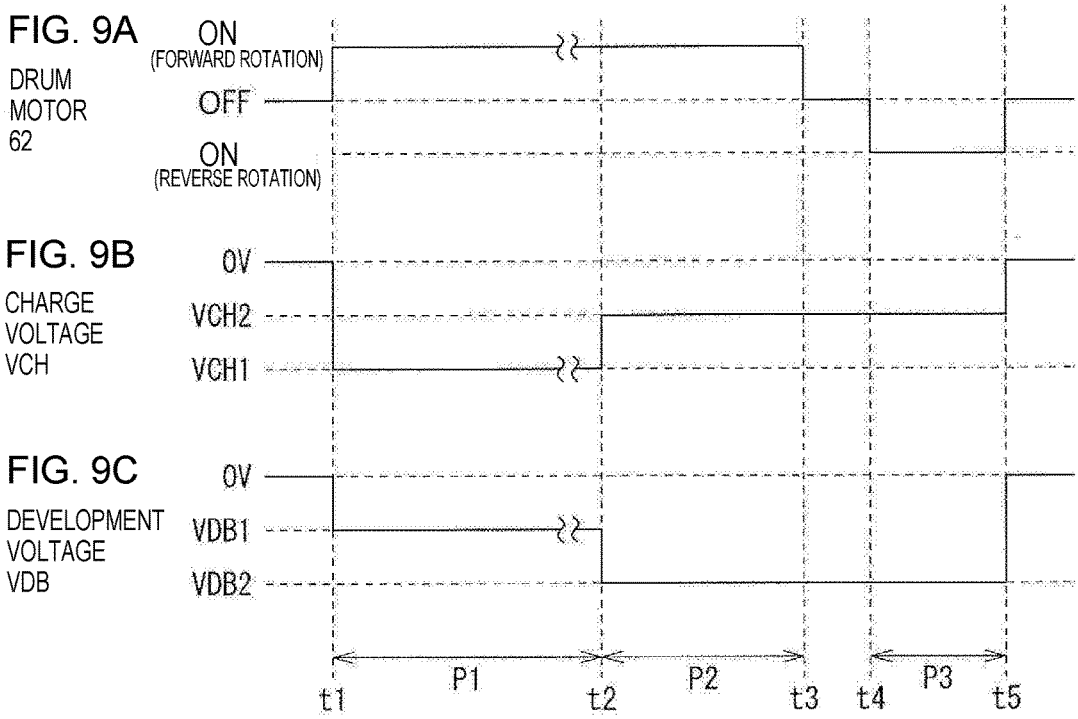
FIG. 9A
DRUM MOTOR 62
ON (FORWARD ROTATION)
OFF
ON (REVERSE ROTATION)
FIG. 9B
CHARGE VOLTAGE VCH
0V
VCH2
VCH1
FIG. 9C
DEVELOPMENT VOLTAGE VDB
0V
VDB1
VDB2
P1
P2
P3
t1
t2
t3
t4
t5

IMAGE FORMATION APPARATUS CONTROLLING CHARGING VOLTAGE AND DEVELOPMENT VOLTAGE

CROSS REFERENCE TO RELATED APPLICATIONS

This application claims priority based on 35 USC 119 from prior Japanese Patent Application No. 2017-138131 filed on Jul. 14, 2017, entitled "IMAGE FORMATION APPARATUS", the entire contents of which are incorporated herein by reference.

BACKGROUND

The present disclosure relates to an image formation apparatus which forms an image.

Image formation apparatuses include ones which use an electrophotographic method. For example, an image formation apparatus using the electrophotographic method exposes a substantially uniformly-charged surface of a photosensitive drum to form an electrostatic latent image, develops the electrostatic latent image to form a toner image, and transfers the toner image to a recording medium. Then, a cleaning blade scrapes off the toner remaining on the photosensitive drum without being transferred (for example, Patent Document 1).

Patent Document 1: Japanese Patent Application Publication No. 2015-219367.

SUMMARY

In the image formation apparatus, there is a demand for high image quality.

An object of an embodiment is to provide an image formation apparatus that can improve the image quality.

An aspect of this disclosure is an image formation apparatus that includes: an image carrier rotatable in a first rotating direction and configured to carry a latent image on a surface; a charging member disposed to face the image carrier at a first position and configured to charge the surface of the image carrier; a developer carrier disposed to face the image carrier at a second position and configured to carry a developer used to develop the latent image; and a controller that controls a rotating operation of the image carrier, application of a charge voltage to the charging member, and application of a development voltage to the developer carrier. In a first period, the controller performs control to apply the charge voltage and the development voltage to the charging member and the developer carrier respectively while rotating the image carrier in the first rotating direction such that the controller sets an absolute value of a voltage difference between a direct-current (DC) component of the charge voltage and a direct-current (DC) component of the development voltage to a first value, to develop the latent image. In a second period after the first period, the controller performs control to apply the charge voltage and the development voltage to the charging member and the developer carrier respectively while rotating the image carrier in the first rotating direction such that the controller sets the absolute value of the voltage difference to a second value smaller than the first value.

According to the aforementioned aspect, since the absolute value of the voltage difference between the DC component of the charge voltage and the DC component of the development voltage is set to the second value smaller than the first value in the second period after the first period in which the latent image is developed, the image quality can be improved.

BRIEF DESCRIPTION OF DRAWINGS

FIGS. 4A to 4C are timing waveform diagrams illustrating an operation example of the image formation apparatus according to a first embodiment;

FIG. 5 is an explanatory diagram illustrating an example of toner near a front end of a cleaning blade;

FIGS. 8A to 8C are timing waveform diagrams illustrating an operation example of an image formation apparatus according to a second embodiment;

FIGS. 9A to 9C are timing waveform diagrams illustrating an operation example of an image formation apparatus according to a modified example of a second embodiment.

DETAILED DESCRIPTION

Figure 1:
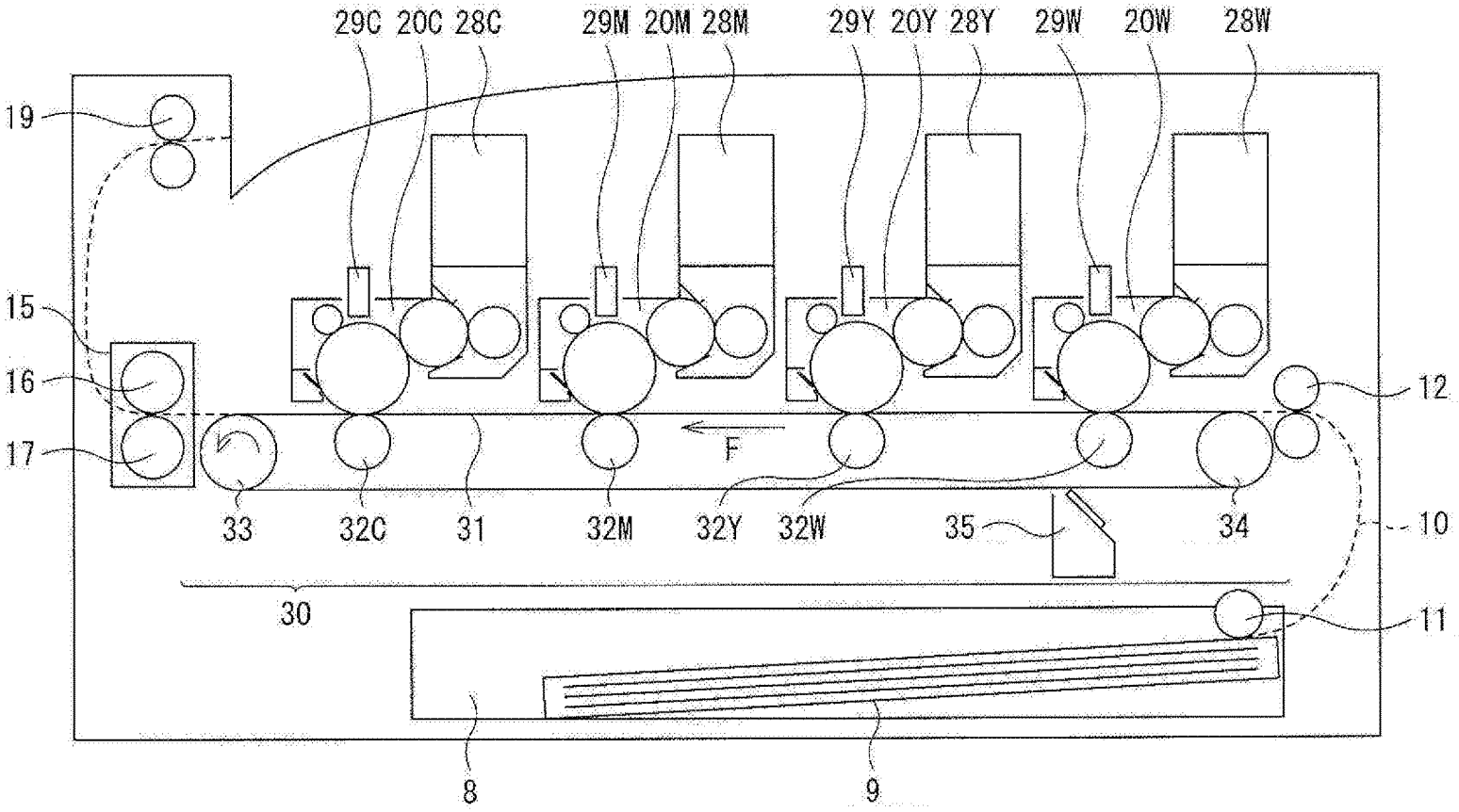
FIG. 1 is a configuration diagram illustrating a configuration example of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only. Note that descriptions are given in the following order:

1. First Embodiment
2. Second Embodiment.

1. First Embodiment

[Configuration Example]

FIG. 1 illustrates a configuration example of an image formation apparatus (image formation apparatus 1) according to one or more embodiments of the present disclosure. The image formation apparatus 1 functions as a printer which forms an image on recording media such as normal sheets or the like, by using an electrophotographic method.

The image formation apparatus 1 includes a hopping roller 11, registration rollers 12, four development units 20 (development units 20W, 20Y, 20M, 20C), four toner containers 28 (toner containers 28W, 28Y, 28M, 28C), four light emitting diode (LED) heads 29 (LED heads 29W, 29Y, 29M, 29C), a transfer unit 30, a fixation unit 15, and discharge rollers 19. These are arranged along a conveyance route 10 through which recording media 9 are conveyed.

The hopping roller 11 is a member which picks up the recording media 9 stored in a medium container 8 one by one from the top and sends out the picked-up recording media 9 to the conveyance route 10.

The registration rollers 12 are a pair of rollers arranged with the conveyance route 10 therebetween. The registration rollers 12 correct skewing of each recording medium 9 supplied from the hopping roller 11 and convey the recording medium 9 along the conveyance route 10.

The four development units 20 form toner images. Specifically, the development unit 20W forms a white (W) toner image, the development unit 20Y forms a yellow (Y) toner image, the development unit 20M forms a magenta (M) toner image, and the development unit 20C forms a cyan (C) toner image. In this example, the four development units 20 are arranged in the order of the development units 20W, 20Y, 20M, 20C in a conveyance direction F of the recording media 9. The development units 20 are each configured to be detachably attached.

The four toner containers 28 store toners. Specifically, the toner container 28W stores a white toner, the toner container 28Y stores a yellow toner, the toner container 28M stores a magenta toner, and the toner container 28C stores a cyan toner. The four toner containers 28 are each configured to be detachably attached to the corresponding one of the four development units 20.

Figure 2:
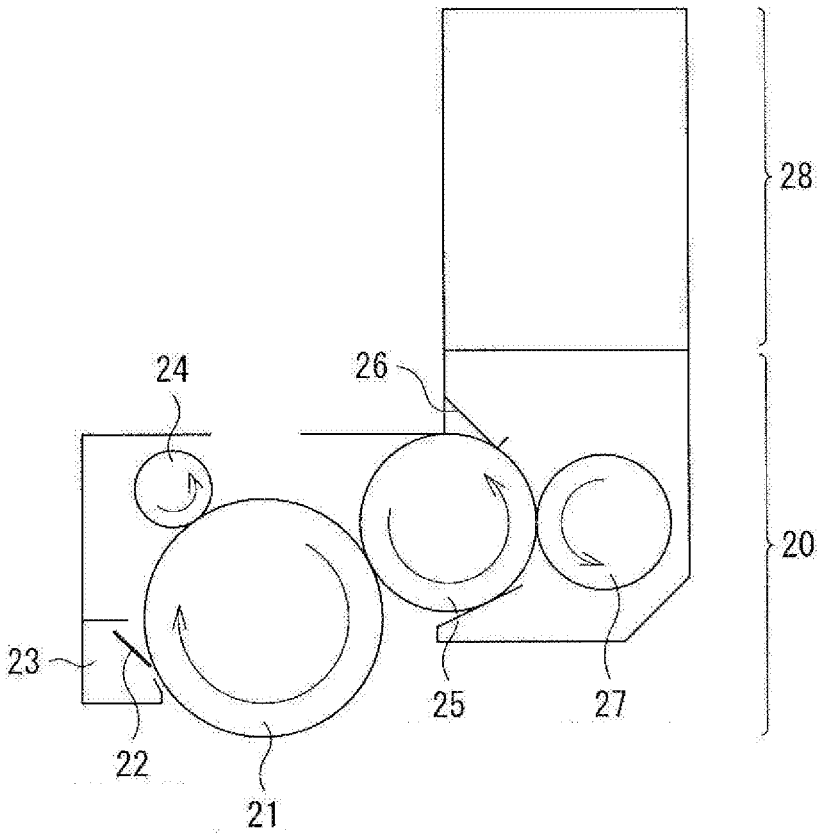
FIG. 2 is a configuration diagram illustrating a configuration example of a development unit illustrated in FIG. 1.

FIG. 2 illustrates a configuration example of each of the development units 20. Note that the corresponding toner container 28 is also illustrated in FIG. 2. The development unit 20 includes a photosensitive drum 21, a cleaning blade 22, a charging roller 24, a development roller 25, a restriction blade 26, and a supply roller 27.

The photosensitive drum 21 is a member which carries an electrostatic latent image on a surface (surface layer portion). For example, a member obtained by forming a charge generation layer with a film thickness of 0.5 μm and a charge transport layer with a film thickness of 20 μm in this order on a surface of a tube made of aluminum with a thickness of 0.75 mm and an outer diameter of 30 mm may be used as the photosensitive drum 21. The photosensitive drum 21 is rotated clockwise in this example by power transmitted from a drum motor 52 (to be described later). The photosensitive drum 21 is charged by the charging roller 24 and is exposed by the corresponding LED head 29. Specifically, the LED head 29W exposes the photosensitive drum 21 of the development unit 20W, the LED head 29Y exposes the photosensitive drum 21 of the development unit 20Y, the LED head 29M exposes the photosensitive drum 21 of the development unit 20M, and the LED head 29C exposes the photosensitive drum 21 of the development unit 20C. The electrostatic latent image is thereby formed on the surface of each photosensitive drum 21. Then, the development roller 25 supplies the toner to the photosensitive drum 21 and the toner image corresponding to the electrostatic latent image is thereby formed on the photosensitive drum 21.

The cleaning blade 22 is a member which cleans the photosensitive drum 21 by scraping off the toner remaining on the surface (surface layer portion) of the photosensitive drum 21. The cleaning blade 22 is made of, for example, rubber and is arranged such that a front end thereof comes into contact with the photosensitive drum 21. The cleaning blade 22 scrapes off, for example, the toner remaining on the surface of the photosensitive drum 21 without being transferred and the old toner supplied from the development roller 25 to the photosensitive drum 21 when a coverage ratio is low. Then, the scraped-off toner is stored in a collected toner box 23. The toner stored in the collected toner box 23 is further conveyed by a not-illustrated toner conveyance mechanism and is stored in a not-illustrated waste toner container.

The charging roller 24 is a member which substantially uniformly charges the surface (surface layer portion) of the photosensitive drum 21. For example, a member obtained by coating an electrically-conductive shaft made of stainless steel or the like with an electrically-conductive elastic body such as epichlorohydrin may be used as the charging roller 24. The charging roller 24 is arranged to come into contact with the surface (circumferential surface) of the photosensitive drum 21 and is arranged to be pressed against the photosensitive drum 21 at a predetermined pressing amount. The charging roller 24 is rotated counterclockwise in this example in correspondence with the rotation of the photosensitive drum 21. A voltage controller 48 (to be described later) applies a charge voltage VCH to the charging roller 24.

The development roller 25 is a member which carries the toner on the surface. For example, a member obtained by forming an elastic layer and a surface layer in this order on a surface (circumferential surface) of an electrically-conductive shaft made of stainless steel or the like can be used as the development roller 25. The elastic layer can be made of, for example, urethane rubber or silicone rubber. The surface layer can be formed by, for example, treating a surface of the elastic layer with a urethane solution or applying an acryl resin or an acryl-fluorine copolymer resin onto the surface of the elastic layer. Carbon black may be blended into the acryl resin or the acryl-fluorine copolymer resin to provide electric conductivity. The development roller 25 is arranged to come into contact with the surface (circumferential surface) of the photosensitive drum 21 and is arranged to be pressed against the photosensitive drum 21 at a predetermined pressing amount. The development roller 25 is rotated counterclockwise in this example by the power transmitted from the not-illustrated drum motor 52 (to be described later). The voltage controller 48 (to be described later) applies a development voltage VDB to the development roller 25.

The restriction blade 26 is a member which forms a layer (toner layer) made of the toner on the surface of the development roller 25 by coming into contact with the surface of the development roller 25 and which restricts (controls, adjusts) the thickness of the toner layer. For example, a member obtained by bending a plate-shaped elastic member made of stainless steel or the like with a plate thickness of 0.08 mm into an L-shape can be used as the restriction blade 26. A radius of curvature of this bent portion can be set to, for example, 0.2 mm. The restriction blade 26 is arranged such that the bent portion comes into contact with the surface of the development roller 25 and is pressed against the development roller 25 at a predetermined pressing amount. A linear pressure against the development roller 25 can be set to, for example, 30 gf/cm. Note that the radius of curvature and the linear pressure are not limited to those described above and may be preferably set depending on the toner amount and the charge amount of the toner on the surface of the development roller 25. The voltage controller 48 (to be described later) applies a restriction voltage VRB to the restriction blade 26.

The supply roller 27 is a member which supplies the toner stored in the toner container 28 to the development roller 25. For example, a member obtained by coating an electrically-conductive shaft made of stainless steel or the like with an elastic body can be used as the supply roller 27. The elastic body may be made of, for example, electrically-conductive silicone rubber foam or electrically-conductive urethane rubber foam. Acetylene black, carbon black, or the like may be added to the elastic body to provide a semiconducting property. The supply roller 27 is arranged to come into contact with the surface (circumferential surface) of the development roller 25 and is arranged to be pressed against the development roller 25 at a predetermined pressing amount. The supply roller 27 is rotated counterclockwise in this example by the power transmitted from the not-illustrated drum motor 52 (to be described later). Friction is thereby generated between the surface of the supply roller 27 and the surface of the development roller 25 in each development unit 20. As a result, the toner is charged by means of so-called triboelectric charging in each development unit 20. The voltage controller 48 (to be described later) applies a supply voltage VSB to the supply roller 27.

Each of the four LED heads 29 (FIG. 1) is a device which emits light to the photosensitive drum 21 of the corresponding development unit 20. For example, each LED head 29 can be formed by using, multiple LED elements, a drive circuit configured to drive the multiple LED elements, and a lens array. The LED head 29W emits light to the photosensitive drum 21 of the development unit 20W, the LED head 29Y emits light to the photosensitive drum 21 of the development unit 20Y, the LED head 29M emits light to the photosensitive drum 21 of the development unit 20M, and the LED head 29C emits light to the photosensitive drum 21 of the development unit 20C. Each of the LED heads 29 thereby exposes the corresponding photosensitive drum 21 and forms the electrostatic latent image on the surface of the photosensitive drum 21.

The transfer unit 30 transfers the toner images formed by the four development units 20 onto a transfer surface of the recording medium 9. The transfer unit 30 includes a transfer belt 31, four transfer rollers 32 (32W, 32Y, 32M, 32C), a drive roller 33, a following roller 34, and a cleaning device 35.

The transfer belt 31 conveys the recording medium 9 in the conveyance direction F along the conveyance route 10. The transfer belt 31 is provided (tensioned) between the drive roller 33 and the following roller 34 in a tensioned manner. Then, the transfer belt 31 is circulated and conveyed in the conveyance direction F depending on the rotation of the drive roller 33.

Each of the four transfer rollers 32 is a member which transfers the toner image formed on the surface of the photosensitive drum 21 of the corresponding development unit 20 to the recording medium 9. Each transfer roller 32 can be formed by using, for example, electrically-conductive elastic foam. The transfer roller 32W is arranged to face the photosensitive drum 21 of the development unit 20W with the conveyance route 10 and the transfer belt 31 therebetween, the transfer roller 32Y is arranged to face the photosensitive drum 21 of the development unit 20Y with the conveyance route 10 and the transfer belt 31 therebetween, the transfer roller 32M is arranged to face the photosensitive drum 21 of the development unit 20M with the conveyance route 10 and the transfer belt 31 therebetween, and the transfer roller 32C is arranged to face the photosensitive drum 21 of the development unit 20C with the conveyance route 10 and the transfer belt 31 therebetween. The voltage controller 48 (to be described later) applies a transfer voltage VTR to each of the transfer rollers 32W, 32Y, 32M, 32C. In the image formation apparatus 1, the toner images formed by the respective development units 20 are thereby transferred onto the transfer surface of the recording medium 9.

The drive roller 33 circulates and conveys the transfer belt 31. In this example, the drive roller 33 is arranged downstream of the four development units 20 in the conveyance direction F. The drive roller 33 is rotated counterclockwise in this example by power transmitted from a belt motor 53 (not illustrated).

The following roller 34 is rotated by following the circulation and conveyance of the transfer belt 31. In this example, the following roller 34 is arranged upstream of the four development units 20 in the conveyance direction F.

The cleaning device 35 is a member which cleans the transfer belt 31 by scraping off the toners remaining on a transfer surface of the transfer belt 31.

The fixation unit 15 is a device which fuses the toner images transferred onto the recording medium 9 to the recording medium 9 by applying heat and pressure to the recording medium 9, and thereby fixes the toner images to the recording medium 9. The fixation unit 15 includes a heat roller 16 and a pressure application roller 17.

The heat roller 16 includes a heater and applies heat to the toners on the recording medium 9. For example, a halogen heater can be used as the heater. For example, a member obtained by forming an elastic layer and a toner separation layer in this order on a surface of a tube made of iron with an outer diameter of 28 mm can be used as the heat roller 16. The elastic layer can be made of, for example, silicone rubber. Moreover, the toner separation layer can be formed by using, for example, a fluororesin tube. The heat roller 16 is rotated by power transmitted from a fixation motor 54.

The pressure application roller 17 is a member which applies pressure to the toners on the recording medium 9 and is arranged to form a pressure contact portion between the pressure application roller 17 and the heat roller 16. For example, a member obtained by forming a toner separation layer on a surface of a tube made of iron can be used as the pressure application roller 17. The toner separation layer can be formed by using, for example, a fluororesin tube. The pressure application roller 17 is rotated by power transmitted from the fixation motor 54.

In the fixation unit 15, this configuration heats, melts, and presses the toners on the recording medium 9. As a result, the toner images are fixed to the recording medium 9.

The discharge rollers 19 are a pair of rollers arranged with the conveyance route 10 therebetween and conveys the recording medium 9 to which the toner images are fixed, along the conveyance route 10 and discharges it.

Figure 3:
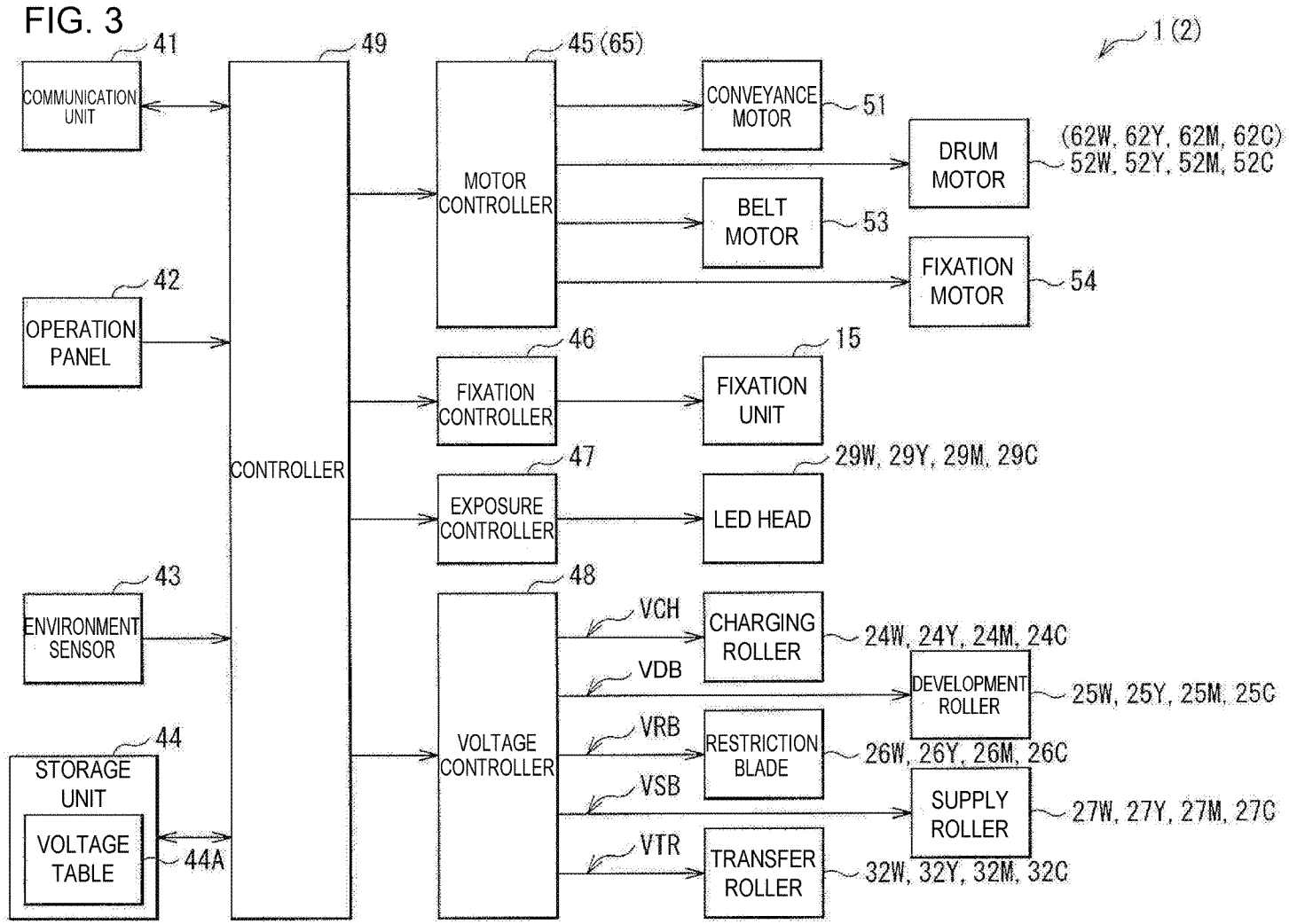
FIG. 3 is a block diagram illustrating a configuration example of the image formation apparatus illustrated in FIG. 1.

FIG. 3 illustrates an example of a control mechanism in the image formation apparatus 1. The image formation apparatus 1 includes a communication unit 41, an operation panel 42, an environment sensor 43, a storage unit 44, a motor controller 45, a conveyance motor 51, the four drum motors 52 (drum motors 52W, 52Y, 52M, 52C), the belt motor 53, the fixation motor 54, a fixation controller 46, an exposure controller 47, the voltage controller 48, and a controller 49. The motor controller 45, the fixation controller 46, the exposure controller 47, the voltage controller 48, and the controller 49 can be implemented using: a memory as a storage device that stores a control program; and a processor that executes the control program stored in the memory. Otherwise, parts of the motor controller 45, the fixation controller 46, the exposure controller 47, the voltage controller 48, and the controller 49 may be implemented using a circuit, and the rests of the motor controller 45, the fixation controller 46, the exposure controller 47, the voltage controller 48, and the controller 49 may be implemented using: a memory as a storage device that stores a control program; and a processor that executes the control program stored in the memory.

The communication unit 41 performs communication by using, for example, a Universal Serial Bus (USB) or a Local Area Network (LAN) and, for example, receives print data DP sent from a host computer (not illustrated).

The operation panel 42 receives an operation made by a user and displays an operating condition and the like of the image formation apparatus 1. The operation panel 42 is formed by using, for example, various buttons, a liquid crystal display, various indicators, and the like.

The environment sensor 43 measures the temperature and humidity around the image formation apparatus 1. The environment sensor 43 is arranged, for example, at a position less likely to be affected by the heat generated in the fixation unit 15.

The storage unit 44 stores various pieces of setting information used in the image formation apparatus 1 and is formed by using a non-volatile memory. The storage unit 44 stores a voltage table 44A. The voltage table 44A stores the voltage setting information on various voltages (charge voltage VCH, development voltage VDB, restriction voltage VRB, supply voltage VSB, and transfer voltage VTR) used in the image formation apparatus 1 in association with the temperature and humidity. The voltage setting information on the charge voltage VCH includes information on two voltages VCH1, VCH2. The voltage VCH1 is the charge voltage VCH applied to the charging roller 24 when the image formation apparatus 1 forms an image on the recording medium 9 and the voltage VCH2 is the charge voltage VCH applied to the charging roller 24 after the image is formed on the recording medium 9 as described later. Similarly, the voltage setting information on the development voltage VDB includes information on two voltages VDB1, VDB2. The voltage VDB1 is the development voltage VDB applied to the development roller 25 when the image formation apparatus 1 forms an image on the recording medium 9 and the voltage VDB2 is the development voltage VDB applied to the development roller 25 after the image is formed on the recording medium 9 as described later.

The motor controller 45 controls operations of the conveyance motor 51, the four drum motors 52 (drum motors 52W, 52Y, 52M, 52C), the belt motor 53, and the fixation motor 54, based on instructions from the controller 49.

The conveyance motor 51 supplies power to the hopping roller 11, the registration rollers 12, and the discharge rollers 19. The four drum motors 52 each supply power to the photosensitive drum 21, the development roller 25, and the supply roller 27 in the corresponding development unit 20. Specifically, the drum motor 52W supplies power to the photosensitive drum 21, the development roller 25, and the supply roller 27 in the development unit 20W, the drum motor 52Y supplies power to the photosensitive drum 21, the development roller 25, and the supply roller 27 in the development unit 20Y, the drum motor 52M supplies power to the photosensitive drum 21, the development roller 25, and the supply roller 27 in the development unit 20M, and the drum motor 52C supplies power to the photosensitive drum 21, the development roller 25, and the supply roller 27 in the development unit 20C. The belt motor 53 supplies power to the drive roller 33 in the transfer unit 30. The fixation motor 54 supplies power to the heat roller 16 and the pressure application roller 17 in the fixation unit 15.

The fixation controller 46 controls the temperature in the fixation unit 15, based on instructions from the controller 49.

The exposure controller 47 controls exposure operations in the four LED heads 29 (LED heads 29W, 29Y, 29M, 29C), based on instructions from the controller 49.

The voltage controller 48 generates the charge voltage VCH, the development voltage VDB, the restriction voltage VRB, the supply voltage VSB, and the transfer voltage VTR used in the four development units 20 and the transfer unit 30, based on instructions from the controller 49. Then, the voltage controller 48 applies the generated charge voltage VCH to the charging rollers 24 (charging rollers 24W, 24Y, 24M, 24C) in the four development units 20, applies the generated development voltage VDB to the development rollers 25 (development rollers 25W, 25Y, 25M, 25C) in the four development units 20, applies the generated restriction voltage VRB to the restriction blades 26 (restriction blades 26W, 26Y, 26M, 26C) in the four development units 20, applies the generated supply voltage VSB to the supply rollers 27 (supply rollers 27W, 27Y, 27M, 27C) in the four development units 20, and applies the generated transfer voltage VTR to the four transfer rollers 32 (transfer rollers 32W, 32Y, 32M, 32C) in the transfer unit 30.

The controller 49 controls an overall operation of the image formation apparatus 1 by controlling operations of blocks in the image formation apparatus 1. The controller 49 is formed by using, for example, a Central Processing Unit (CPU), a Random Access Memory (RAM) which functions as a temporal storage region, a Read Only Memory (ROM) which stores a program executed by the CPU, and the like.

Moreover, the controller 49 has a function of obtaining the voltage setting information on the charge voltage VCH (voltages VCH1, VCH2), the development voltage VDB (voltages VDB1, VDB2), the restriction voltage VRB, the supply voltage VSB, and the transfer voltage VTR by using the voltage table 44A based on the detection result of the environment sensor 43 and supplying the obtained voltage setting information to the voltage controller 48. The image formation apparatus 1 can thereby form an image on the recording medium 9 in an optimal condition depending on the ambient temperature and humidity.

The photosensitive drum 21 corresponds to an example of an "image carrier" in the present disclosure. The charging roller 24 corresponds to an example of a "charging member" in the present disclosure. The development roller 25 corresponds to an example of a "developer carrier" in the present disclosure. The motor controller 45, the voltage controller 48, and the controller 49 correspond to an example of a "controller" in the present disclosure. The cleaning blade 22 corresponds to an example of a "cleaning member" in the present disclosure.

[Operations and Effects]

Next, operations and effects of the image formation apparatus 1 are described.

(Outline of Overall Operation)

First, an outline of an overall operation of the image formation apparatus 1 is described with reference to FIGS. 1 to 3. When the communication unit 41 receives the print data DP from the host computer, the controller 49 controls the blocks in the image formation apparatus 1 such that the image formation apparatus 1 starts an image formation operation. The motor controller 45 controls the operations of the conveyance motor 51, the four drum motors 52 (drum motors 52W, 52Y, 52M, 52C), the belt motor 53, and the fixation motor 54, based on the instructions from the controller 49. The fixation controller 46 controls the temperature in the fixation unit 15, based on the instruction from the controller 49. The exposure controller 47 controls the exposure operations in the four LED heads 29 (LED heads 29W, 29Y, 29M, 29C), based on the instructions from the controller 49. The controller 49 obtains the voltage setting information on the charge voltage VCH (voltages VCH1, VCH2), the development voltage VDB (voltages VDB1, VDB2), the restriction voltage VRB, the supply voltage VSB, and the transfer voltage VTR by using the voltage table 44A based on the detection result of the environment sensor 43, and supplies the obtained voltage setting information to the voltage controller 48. The voltage controller 48 generates the charge voltage VCH, the development voltage VDB, the restriction voltage VRB, the supply voltage VSB, and the transfer voltage VTR used in the four development units 20 and the transfer unit 30, based on the instructions from the controller 49.

In each of the four development units 20, the electrostatic latent image is formed on the surface of the photosensitive drum 21, and the toner image corresponding to the formed electrostatic latent image is formed (developed). The four transfer rollers 32 transfer the toner images formed on the respective photosensitive drums 21 onto the transfer surface of the recording medium 9. The fixation unit 15 fixes the toner images to the recording medium 9.

(Detailed Operation)

Next, operations in each of the development units 20 are described in detail. First, the voltage controller 48 applies the generated charge voltage VCH (voltage VCH1) to the charging roller 24. The surface of the photosensitive drum 21 is thereby substantially uniformly charged. Then, the LED head 29 emits light to the photosensitive drum 21, based on the instruction from the exposure controller 47. The electrostatic latent image is thereby formed on the surface of the photosensitive drum 21. Moreover, the voltage controller 48 applies the generated supply voltage VSB to the supply roller 27, applies the generated restriction voltage VRB to the restriction blade 26, and applies the generated development voltage VDB (voltage VDB1) to the development roller 25. A substantially-uniform toner layer is thereby formed on the surface of the development roller 25 and the charge amount of the toner in the toner layer is set to a predetermined negative charge amount. Then, the toner moves from the development roller 25 to the photosensitive drum 21. The electrostatic latent image on the surface of the photosensitive drum 21 is thereby developed and the toner image is formed. The voltage controller 48 applies the generated transfer voltage VTR to the transfer roller 32. The toner image on the surface of the photosensitive drum 21 is thereby transferred to the transfer surface of the recording medium 9. The toner remaining on the surface of the photosensitive drum 21 without being transferred is removed by being scraped off by the cleaning blade 22.

(Regarding Charge Voltage VCH and Development Voltage VDB)

In a period from a point after the formation of the image on the recording medium 9 to stop of the operation of the drum motor 52, the voltage controller 48 sets the charge voltage VCH and the development voltage VDB to voltages different from those during the image formation. This operation is described below in detail.

FIGS. 4A to 4C illustrate an operation example of the image formation apparatus 1, FIG. 4A illustrates an operation of the drum motor 52, FIG. 4B illustrates a waveform of the charge voltage VCH, and FIG. 4C illustrates a waveform of the development voltage VDB. When an image is formed on the recording medium 9, the voltage controller 48 sets the charge voltage VCH to the voltage VCH1 and sets the development voltage VDB to the voltage VDB1. After the image is formed on the recording media 9, the voltage controller 48 changes the charge voltage VCH from the voltage VCH1 to the voltage VCH2 and changes the development voltage VDB from the voltage VDB1 to the voltage VDB2. This operation is described below in detail.

In this example, the motor controller 45 turns on the drum motor 52 at timing t1 (FIG. 4A). The drum motor 52 thereby starts a forward rotation operation and, in response to this, the photosensitive drum 21, the charging roller 24, the development roller 25, and the supply roller 27 start to rotate. In this case, since the drum motor 52 performs the forward rotation operation, for example, the photosensitive drum 21 rotates clockwise as illustrated in FIG. 2.

Moreover, at the timing t1, the voltage controller 48 sets the charge voltage VCH to the voltage VCH1 (for example, −1000 V) and sets the development voltage VDB to the voltage VDB1 (for example, −150V) (FIGS. 4B and 4C). In the development unit 20, the image is formed on the recording medium 9 in a period from the timing t1 to timing t2 (image forming period P1).

Then, at the timing t2, for example, when a trailing end of the recording medium 9 passes a portion where the photosensitive drum 21 and the transfer roller 32 face each other, the voltage controller 48 changes the charge voltage VCH from the voltage VCH1 (for example, −1000 V) to the voltage VCH2 (for example, −850 V) and changes the development voltage VDB from the voltage VDB1 (for example, −150 V) to the voltage VDB2 (for example, −200V) (FIGS. 4B and 4C). In this case, the voltage controller 48 sets the charge voltage VCH and the development voltage VDB such that the absolute value of the voltage difference ΔV (=VCH−VDB) between the charge voltage VCH and the development voltage VDB is smaller than the absolute value of the voltage difference ΔV in the image forming period P1. Note that, in a period from the timing t2 to timing t3 (period P2), the drum motor 52 continues the forward rotation operation.

It may be preferable that the duration of the period P2 from the timing t2 to the timing t3 is longer than, for example, the time taken for the photosensitive drum 21 to rotate by a distance from the position facing the charging roller 24 to the position facing the cleaning blade 22. Specifically, it may be preferable that, in the period P2, a portion of the surface of the photosensitive drum 21 facing the charging roller 24 at the moment when the charge voltage VCH is changed to the voltage VCH2 at the timing t2 passes the position facing the development roller 25 and further rotationally moves beyond the position facing the cleaning blade 22.

Then, at the timing t3, for example, when the recording medium 9 is conveyed to the fixation unit 15 and the trailing end of the recording medium 9 moves away from the transfer belt 31, the motor controller 45 turns off the drum motor 52 (FIG. 4A). The photosensitive drum 21, the charging roller 24, the development roller 25, and the supply roller 27 are thereby stopped. Moreover, at the timing t3, the voltage controller 48 sets the charge voltage VCH and the development voltage VDB to 0 V (FIGS. 4B and 4C).

Here, the image forming period P1 corresponds to an example of a "first period" in the present disclosure and the period P2 corresponds to an example of a "second period" in the present disclosure.

In the image formation apparatus 1, since the absolute value of the voltage difference ΔV between the charge voltage VCH and the development voltage VDB in the period P2 subsequent to the image forming period P1 is set smaller than the absolute value of the voltage difference ΔV in the image forming period P1 as described above, the image quality can be improved as described below.

Specifically, in the image formation apparatus 1, the period P2 is provided after the moment when the trailing end of the recording medium 9 passes the portion where the photosensitive drum 21 and the transfer roller 32 face each other and before the moment when the operation of the drum motor 52 is stopped, in consideration of an operation margin and the like. Particularly, the more upstream the development unit 20 among the four development units 20 is located, the longer the duration of this period P2 is. In the period P2, since the LED head 29 does not operate, no electrostatic latent image is formed on the photosensitive drum 21. However, for example, the toner in the toner layer on the surface of the development roller 25 may move to the photosensitive drum 21 as so-called gray background toner. In this description, the "gray background toner" is toner adhering to a portion of the photosensitive drum 21 where an image is not to be formed. For example, toner with low charge amount or positively-charged toner may move from the development roller 25 to the portion of the photosensitive drum 21 where an image is not to be formed, as the gray background toner. In the period P2, since the photosensitive drum 21 continues to rotate, as illustrated in FIG. 5, the toner having moved from the development roller 25 to the photosensitive drum 21 is accumulated near the front end of the cleaning blade 22. Part of the thus-accumulated toner is stored in the collected toner box 23 and the rest of the toner remains near the front end of the cleaning blade 22. Since the cleaning blade 22 applies pressure to the toner near the front end of the cleaning blade 22, the toner near the front end of the cleaning blade 22 sometimes turns into a chunk of toner, for example, when the photosensitive drum 21 is stopped for a long time.

When the next image forming operation starts and the photosensitive drum 21 starts to rotate, the toner accumulated near the front end of the cleaning blade 22 as described above may pass through the cleaning blade 22. Specifically, for example, when the photosensitive drum 21 starts to rotate, unlike when the photosensitive drum 21 is steadily rotating, for example, the toner accumulated near the front end of the cleaning blade 22 has turned into the chunk of toner as described above. Moreover, when the photosensitive drum 21 starts to rotate, the state of the pressure applied by the cleaning blade 22 is different from that in the case where the photosensitive drum 21 is steadily rotating. Accordingly, when the next rotation of the photosensitive drum 21 starts, the toner accumulated near the front end of the cleaning blade 22 may pass through the cleaning blade 22. When the toner passes through the cleaning blade 22 as described above, the charging roller 24 charges the surface of the photosensitive drum 21 and the LED head 29 emits light to the photosensitive drum 21 with the toner being present on the surface of the photosensitive drum 21. Accordingly, the image quality may be decreased.

In view of this, in the image formation apparatus 1, the absolute value of the voltage difference ΔV between the charge voltage VCH and the development voltage VDB in the period P2 is set to be smaller than the absolute value of the voltage difference ΔV in the image forming period P1. This can reduce the risk that the toner in the toner layer on the surface of the development roller 25 moves to the photosensitive drum 21 in the period P2, as described later by using an experimental example. Hence, in the image formation apparatus 1, it is possible to reduce the amount of the toner accumulated near the front end of the cleaning blade 22 and thus reduce the risk of the toner passing through the cleaning blade 22 when the photosensitive drum 21 starts to rotate. As a result, the image quality can be improved.

(Relationship Between Gray Background Toner and Voltage Difference ΔV)

Figures 6, 7:
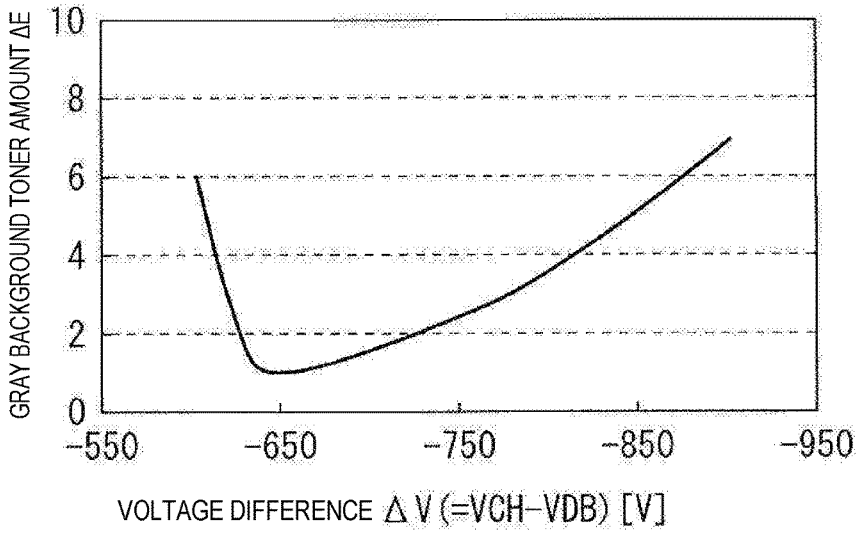
FIG. 6 is a characteristic diagram illustrating an example of a gray background toner amount.
FIG. 7 is a table illustrating a setting example of a charge voltage and a development voltage.

FIG. 6 illustrates an experimental example depicting a relationship between an amount of gray background toner and the voltage difference ΔV (=VCH−VDB) at a certain temperature and certain humidity. The horizontal axis represents the voltage difference ΔV and the vertical axis represents the amount of gray background toner (gray background toner amount ΔE). In this example, the gray background toner amount ΔE is described in an arbitrary unit. In this example, the gray background toner amount ΔE is an amount obtained by collecting the toner on the surface of the photosensitive drum 21 by using a transparent adhesive tape and measuring the color difference between the used adhesive tape and the adhesive tape with no toner. In this experiment, the charge amount of the toner on the surface of the development roller 25 is −3.6 μC/g, the potential of the toner layer on the surface of development roller 25 is −37 V, and the toner amount per unit area on the surface of the development roller 25 is 0.89 mg/cm$^2$.

As illustrated in FIG. 6, as the absolute value of the voltage difference ΔV decreases from 950 V, the gray background toner amount ΔE decreases. Specifically, as the absolute value of the voltage difference ΔV decreases from 950 V, the toner with low charge amount and the positively-charged toner tend not to move from the development roller 25 to the photosensitive drum 21, and the gray background toner amount ΔE thus decreases.

Moreover, the gray background toner amount ΔE is smallest around a point where the absolute value of the voltage difference ΔV is 650 V. When the absolute value of the voltage difference ΔV further falls below 650 V, the gray background toner amount ΔE increases. Specifically, as the absolute value of the voltage difference ΔV decreases from 650 V, force holding the negatively-charged desirable toner on the development roller 25 becomes weaker, and this toner tends to move to the photosensitive drum 21. Thus, the gray background toner amount ΔE increases.

Accordingly, for example, as illustrated in FIG. 7, in the image forming period P1, the charge voltage VCH and the development voltage VDB can be set to −1000V and −150 V, respectively. Moreover, in the period P2 after the image forming period P1, the charge voltage VCH and the development voltage VDB can be set to −850 V and −200 V, respectively. The voltage difference ΔV in the image forming period P1 is −850 V and the voltage difference ΔV in the period P2 is −650 V. The voltage difference ΔV in the period P2 corresponds to the voltage difference at which the gray background toner amount ΔE is small as illustrated in FIG. 6. These voltages are examples and may be set depending on the temperature and humidity, based on the voltage table 44A.

Note that, as illustrated FIG. 7, the absolute value of the charge voltage VCH is set to be larger than the absolute value of the development voltage VDB in the period P2 as in the image forming period P1. Specifically, the absolute value of the charge voltage VCH applied to the charging roller 24 is set to be larger than the absolute value of the development voltage VDB to increase the absolute value of the surface potential of the photosensitive drum 21.

As described above, in the image formation apparatus 1, for example, the voltage difference ΔV in the period P2 after the image forming period P1 can be set to a voltage difference at which the gray background toner amount ΔE is small. In the image formation apparatus 1, this can reduce the risk that the toner in the toner layer on the surface of the development roller 25 moves to the photosensitive drum 21 as the gray background toner in the period P2. As a result, in the image formation apparatus 1, it is possible to reduce the risk of the toner passing through the cleaning blade 22 when the next rotation of the photosensitive drum 21 starts, and thus improve the image quality.

[Effect]

In one or more embodiments described above, since the absolute value of the voltage difference between the charge voltage and the development voltage in the period after the image forming period is set to be smaller than that in the image forming period, it is possible to reduce the risk of the toner moving from the development roller to the photosensitive drum in this period and thus improve the image quality.

Modified Example 1-1

Although the absolute value of the voltage difference ΔV in the period P2 is set smaller than that in the image forming period P1 by changing both of the charge voltage VCH and the development voltage VDB in the embodiment illustrated in FIG. 7, the present disclosure is not limited to this configuration. Alternatively, for example, the absolute value of the voltage difference ΔV in the period P2 may be set smaller than that in the image forming period P1 by changing the charge voltage VCH while keeping the development voltage VDB constant or by changing the development voltage VDB while keeping the charge voltage VCH constant. In the case of changing the development voltage VDB while keeping the charge voltage VCH constant, the duration of the period P2 may be preferably longer than, for example, the time taken for the photosensitive drum 21 to rotate by the distance from the position facing the development roller 25 to the position facing the cleaning blade 22.

Modified Example 1-2

Although the voltage controller 48 applies the charge voltage VCH being a direct-current (DC) voltage to the charging roller 24 and applies the development voltage VDB being a DC voltage to the development roller 25 in the one or more embodiments described above, the present disclosure is not limited to this configuration. Alternatively, for example, the voltage controller 48 may apply the charge voltage VCH including a DC component and an alternating-current (AC) component to the charging roller 24 and apply the development voltage VDB being a DC voltage to the development roller 25. In this case, it may be preferable that the absolute value of the voltage difference between the DC component of the charge voltage VCH and the development voltage VDB (DC voltage) in the period P2 after the image forming period P1 is set smaller than that in the image forming period P1. Similarly, for example, the voltage controller 48 may apply the charge voltage VCH being a DC voltage to the charging roller 24 and apply the development voltage VDB including a DC component and an AC component to the development roller 25. In this case, it may be preferable that the absolute value of the voltage difference between the charge voltage VCH (DC voltage) and the DC component of the development voltage VDB in the period P2 after the image forming period P1 is set smaller than that in the image forming period P1. As another alternative, for example, the voltage controller 48 may apply the charge voltage VCH including a DC component and an AC component to the charging roller 24 and apply the development voltage VDB including a DC component and an AC component to the development roller 25. In this case, it may be preferable that the absolute value of the voltage difference between the DC component of the charge voltage VCH and the DC component of the development voltage VDB in the period P2 after the image forming period P1 is set smaller than that in the image forming period P1.

Modified Example 1-3

Although the charge voltage VCH and the development voltage VDB are set to 0 V and the drum motor 52 is stopped at the timing t3 in the one or more embodiments described above, the present disclosure is not limited to this configuration. Alternatively, for example, the configuration may be such that the charge voltage VCH and the development voltage VDB are set to 0 V and then the drum motor 52 is stopped or such that the drum motor 52 is stopped and then the charge voltage VCH and the development voltage VDB are set to 0 V.

Other Modified Examples

Moreover, two or more of the aforementioned modified examples may be combined.

2. Second Embodiment

Next, an image formation apparatus 2 according to a second embodiment is described. In a second embodiment, the photosensitive drum 21 rotates in a reverse direction after the period P2. Note that component parts which are substantially the same as those in the image formation apparatus 1 are denoted by the same reference numerals and description thereof is omitted as appropriate.

As illustrated in FIG. 3, the image formation apparatus 2 includes a motor controller 65 and four drum motors 62 (drum motors 62W, 62Y, 62M, 62C).

The four drum motors 62 each supply power to the photosensitive drum 21, the development roller 25, and the supply roller 27 in a corresponding one of the development units 20. The four drum motors 62 are configured to perform not only the forward rotation operation but also a reverse rotation operation.

The motor controller 65 controls the operations of the conveyance motor 51, the four drum motors 62 (drum motors 62W, 62Y, 62M, 62C), the belt motor 53, and the fixation motor 54, based on the instructions from the controller 49. The motor controller 65 causes the drum motors 62 to perform the forward rotation operation in the image forming period P1 and the period P2 and to perform the reverse rotation operation after the period P2.

FIGS. 8A to 8C illustrate an operation example of the image formation apparatus 2, FIG. 8A illustrates an operation of the drum motor 62, FIG. 8B illustrates a waveform of the charge voltage VCH, and FIG. 8C illustrates a waveform of the development voltage VDB.

In this example, at the timing t1, the motor controller 65 controls the drum motor 62 such that the drum motor 62 rotates forward (FIG. 8A). The drum motor 62 thereby starts the forward rotation operation and, in response to this, the photosensitive drum 21, the charging roller 24, the development roller 25, and the supply roller 27 start to rotate. In this case, since the drum motor 62 performs the forward rotation operation, for example, the photosensitive drum 21 starts to rotate clockwise as illustrated in FIG. 2. The rotation speed of the photosensitive drum 21 in this case can be set to, for example, 160 mm/sec. In this example, the rotation speed of the photosensitive drum 21 is indicated by the movement speed of the circumferential surface of the photosensitive drum 21.

Moreover, at the timing t1, the voltage controller 48 sets the charge voltage VCH to the voltage VCH1 (for example, −1000 V) and sets the development voltage VDB to the voltage VDB1 (for example, −150V) (FIGS. 8B and 8C). In the development unit 20, the image is formed on the recording medium 9 in the period from the timing t1 to the timing t2 (image forming period P1).

Then, at the timing t2, for example, when the trailing end of the recording medium 9 passes the portion where the photosensitive drum 21 and the transfer roller 32 face each other, the voltage controller 48 changes the charge voltage VCH from the voltage VCH1 (for example, −1000 V) to the voltage VCH2 (for example, −850 V) and changes the development voltage VDB from the voltage VDB1 (for example, −150 V) to the voltage VDB2 (for example, −200V) (FIGS. 8B and 8C). In the period from the timing t2 to the timing t3 (period P2), the drum motor 62 continues the forward rotation operation.

Then, at the timing t3, for example, when the recording medium 9 is conveyed to the fixation unit 15 and the trailing end of the recording medium 9 moves away from the transfer belt 31, the motor controller 65 turns off the drum motor 62 (FIG. 8A). The photosensitive drum 21, the charging roller 24, the development roller 25, and the supply roller 27 are thereby stopped. Moreover, at the timing t3, the voltage controller 48 sets the charge voltage VCH and the development voltage VDB to 0 V (FIGS. 8B and 8C).

Next, at timing t4, the motor controller 65 controls the drum motor 62 such that the drum motor 62 rotates reversely (FIG. 8A). The drum motor 62 thereby starts the reverse rotation operation and, in response to this, the photosensitive drum 21, the charging roller 24, the development roller 25, and the supply roller 27 start to rotate. In this case, since the drum motor 62 performs the reverse rotation operation, for example, the photosensitive drum 21 starts to rotate counterclockwise which is a rotating direction opposite to the rotating direction illustrated in FIG. 2. The rotation speed of the photosensitive drum 21 in this case can be set to, for example, 46 mm/sec. Specifically, in this example, the rotation speed of the photosensitive drum 21 is set to be lower than that in the image forming period P1 to more accurately control the amount of rotation of the photosensitive drum 21 in the reverse direction.

Then, at timing t5, the motor controller 65 turns off the drum motor 62 (FIG. 8A). The photosensitive drum 21, the charging roller 24, the development roller 25, and the supply roller 27 are thereby stopped. A duration of a period P3 from the timing t4 to the timing t5 can be set to, for example, 40 msec.

Here, the image forming period P1 corresponds to an example of the "first period" in the present disclosure, the period P2 corresponds to an example of the "second period" in the present disclosure, and the period P3 corresponds to an example of a "third period" in the present disclosure.

As described above, in the image formation apparatus 2, the photosensitive drum 21 rotates in the reverse direction in the period P3 after the period P2. The photosensitive drum 21 thereby rotates in the reverse direction by, for example, about 1.8 mm (=46 mm/sec.×40 msec.). Thus, the toner can be removed from the portion near the front end of the cleaning blade 22. In this case, even if part of the toner remains on the surface of the photosensitive drum 21, this toner moves away from, for example, the cleaning blade 22 and thus receives no pressure from the cleaning blade 22. Accordingly, it is possible to reduce the risk of formation of a chunk of the toner. As a result, it is possible to reduce the risk of the toner passing through the cleaning blade 22 when the next rotation of the photosensitive drum 21 starts, and thus improve the image quality.

As described above, in a second embodiment, since the photosensitive drum rotates in the reverse direction in the period P3 after the period P2, it is possible to remove the toner from the portion near the front end of cleaning blade and thus improve the image quality. Other effects are as the same as those in a first embodiment.

Modified Example 2-1

Although the voltage controller 48 sets the charge voltage VCH and the development voltage VDB to 0 V at the timing t3 and then the drum motor 62 performs the reverse rotation operation in the period P3 from the timing t4 to the timing t5 in the embodiment illustrated in FIGS. 8A to 8C, the present disclosure is not limited to this. Alternatively, for example, as illustrated in FIGS. 9A to 9C, the drum motor 62 may perform the reverse rotation operation with the charge voltage VCH set to the voltage VCH2 and the development voltage VDB set to the voltage VDB2. In this example, the voltage controller 48 sets the charge voltage VCH and the development voltage VDB to 0 V at the timing t5 at which the reverse rotation operation of the drum motor 62 is stopped.

Modified Example 2-2

The modified examples of the one or more first embodiments may be applied to the image formation apparatus 2 according to the one or more second embodiments.

Although the present technique has been described above by using several embodiments and modified examples, the present technique is not limited to these embodiments and the like and various modifications can be made.

Figure 10:
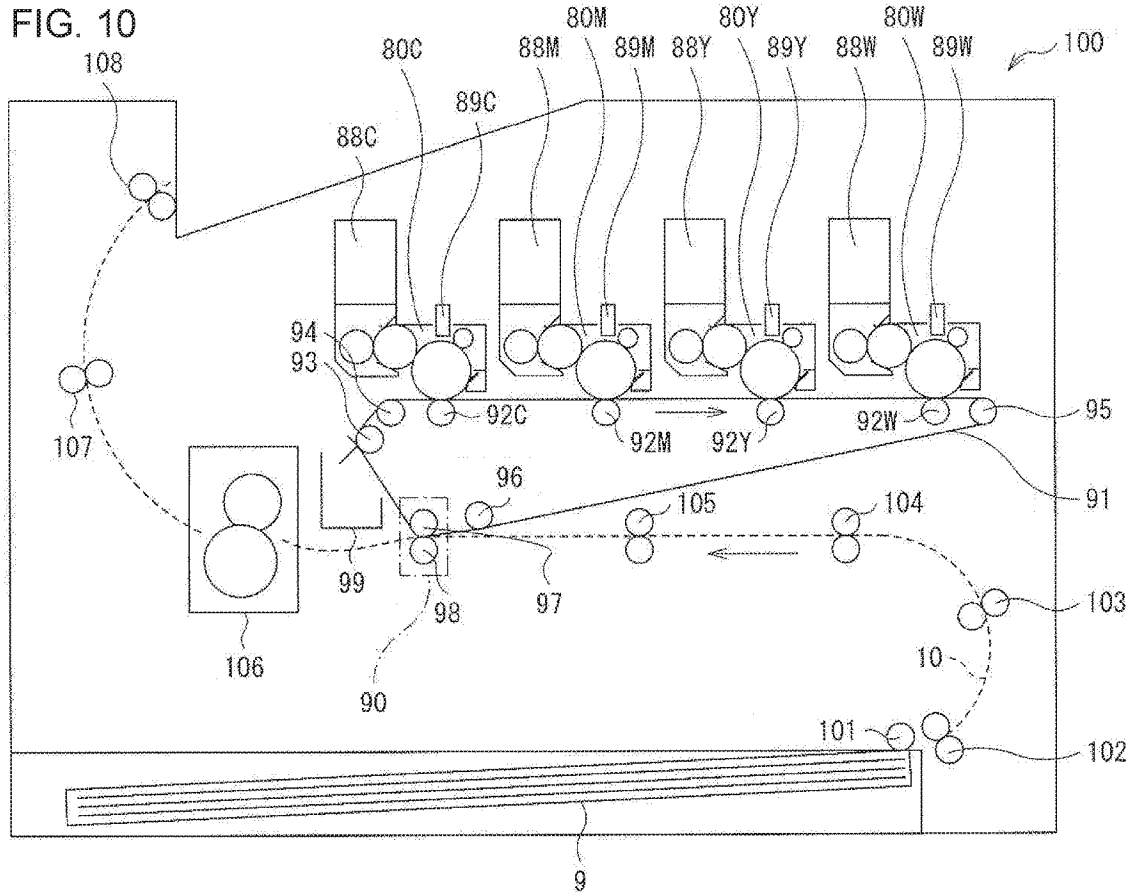
FIG. 10 is a configuration diagram illustrating a configuration example of an image formation apparatus according to a modified example.

For example, although the transfer unit 30 directly transfers the toner images formed by the development units 20 to the recording media 9 in the one or more embodiments described above, the present disclosure is not limited to this. Alternatively, as in an image formation apparatus 100 illustrated in FIG. 10, the configuration may be such that the toner images formed by the development units are temporarily transferred to an intermediate transfer belt and the toner images transferred to the intermediate transfer belt are transferred to the recording medium 9. The image formation apparatus 100 includes four development units 80 (80C, 80M, 80Y, 80W), four toner containers 88 (88C, 88M, 88Y, 88W), four LED heads 89 (89C, 89M, 89Y, 89W), an intermediate transfer belt 91, four primary transfer rollers 92 (92C, 92M, 92Y, 92W), a drive roller 93, following rollers 94 to 96, a backup roller 97, a secondary transfer roller 98, and a cleaning device 99. The image formation apparatus 100 also includes a hopping roller 101, conveyance rollers 102, registration rollers 103, conveyance rollers 104, 105, a fixation unit 106, conveyance rollers 107, and discharge rollers 108. As in the one or more embodiments described above, in each of the four development units 80, an electrostatic latent image is formed and the toner image is formed depending on the formed electrostatic latent image. The primary transfer rollers 92 transfer (perform primary transfer of) the toner images formed in the development units 80 to a transfer surface of the intermediate transfer belt 91. A secondary transfer unit 90 including the backup roller 97 and the secondary transfer roller 98 transfers (performs secondary transfer of) the toner images on the transfer surface of the intermediate transfer belt 91, to the recording medium 9. The fixation unit 106 fixes the toner images to the recording medium 9. In this case, the timing t2 illustrated in FIGS. 4A to 4C, 8A to 8C, and 9A to 9C can be set to, for example, timing at which the trailing end of the recording medium 9 passes a portion where the photosensitive drum of the development unit 80 and the primary transfer roller 92 face each other. Moreover, the timing t3 illustrated in FIGS. 4A to 4C, 8A to 8C, and 9A to 9C can be set to, for example, timing at which the trailing end of the recording medium 9 passes the secondary transfer unit 90.

For example, the diameters of the respective rollers, the thicknesses of the respective members, the applied voltages, the rotation speeds of the respective rollers, and the like in the one or more embodiments described above are merely examples and may be changed as appropriate.

For example, although a color image is formed on the recording medium 9 in the one or more embodiments described above, the present disclosure is not limited to this and a monochrome image may be formed.

For example, although the present technique is applied to a single-function printer in the one or more embodiments described above, the present disclosure is not limited to this. Alternatively, the present technique may be applied to, for example, a so-called multi-function peripheral (MFP) which has functions such as a photocopying function, a facsimile function, a scanning function, and a printing function.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

an image carrier rotatable in a first rotating direction and in a second rotating direction opposite to the first rotating direction and configured to carry a latent image on a surface;

a charging member disposed to face the image carrier at a first position and configured to charge the surface of the image carrier;

a developer carrier disposed to face the image carrier at a second position and configured to carry a developer used to develop the latent image; and a controller that controls a rotating operation of the image carrier, application of a charge voltage to the charging member, and application of a development voltage to the developer carrier, wherein the controller in a first period, performs control to apply the charge voltage and the development voltage to the charging member and the developer carrier respectively while rotating the image carrier in the first rotating direction such that the controller sets an absolute value of a voltage difference between a direct-current (DC) component of the charge voltage and a direct-current (DC) component of the development voltage to a first value, to develop the latent image, in a second period after the first period, performs control to apply the charge voltage and the development voltage to the charging member and the developer carrier respectively while rotating the image carrier in the first rotating direction such that the controller sets the absolute value of the voltage difference to a second value smaller than the first value, and in a third period after the second period, rotates the image carrier in the second rotating direction.

2. The image formation apparatus according to claim 1, wherein the controller performs control to stop the rotating operation of the image carrier, the application of the charge voltage to the charging member, and the application of the development voltage to the developer carrier at an end of the second period.

3. The image formation apparatus according to claim 1, wherein the DC component of the charge voltage and the DC component of the development voltage are different from each other in the second period.

4. The image formation apparatus according to claim 3, wherein an absolute value of the DC component of the charge voltage is larger than an absolute value of the DC component of the development voltage in the first period and the second period.

5. The image formation apparatus according to claim 1, further comprising a cleaning member in contact with the image carrier at a third position and configured to remove the developer adhering to the surface of the image carrier.

6. The image formation apparatus according to claim 1, wherein the charge voltage further includes an alternating-current (AC) component in addition to the DC component.

7. The image formation apparatus according to claim 1, wherein the development voltage further includes an alternating-current (AC) component in addition to the DC component.

8. An image formation apparatus comprising:

an image carrier rotatable in a first rotating direction and configured to carry a latent image on a surface;

a charging member disposed to face the image carrier at a first position and configured to charge the surface of the image carrier;

a developer carrier disposed to face the image carrier at a second position and configured to carry a developer used to develop the latent image;

a cleaning member in contact with the image carrier at a third position and configured to remove the developer adhering to the surface of the image carrier; and a controller that controls a rotating operation of the image carrier, application of a charge voltage to the charging member, and application of a development voltage to the developer carrier, wherein the controller in a first period, performs control to apply the charge voltage and the development voltage to the charging member and the developer carrier respectively while rotating the image carrier in the first rotating direction such that the controller sets an absolute value of a voltage difference between a direct-current (DC) component of the charge voltage and a direct-current (DC) component of the development voltage to a first value, to develop the latent image, and in a second period after the first period, performs control to apply the charge voltage and the development voltage to the charging member and the developer carrier respectively while rotating the image carrier in the first rotating direction such that the controller sets the absolute value of the voltage difference to a second value smaller than the first value, and wherein the controller sets the absolute value of the voltage difference to the second value by changing at least one of the charge voltage and the development voltage, and a duration of the second period is longer than time taken for the image carrier to rotate in the first rotating direction by a distance from the first position to the third position.

9. The image formation apparatus according to claim 8, wherein the controller sets the absolute value of the voltage difference to the second value by changing the charge voltage out of the charge voltage and the development voltage.

10. The image formation apparatus according to claim 8, wherein the controller sets the absolute value of the voltage difference to the second value by changing the development voltage out of the charge voltage and the development voltage.

11. The image formation apparatus according to claim 8, wherein the controller sets the absolute value of the voltage difference to the second value by changing both of the charge voltage and the development voltage.

* * * * *